US007607247B2

(12) United States Patent
Jenkins

(10) Patent No.: US 7,607,247 B2
(45) Date of Patent: Oct. 27, 2009

(54) ENVELOPE WITH INTERIOR DECORATIVE ELEMENTS

(76) Inventor: Kaluve D. Jenkins, 3990 Kenner Dr., Atlanta, GA (US) 30331

( * ) Notice: Subject to any disclaimer, the term of this patent is extended or adjusted under 35 U.S.C. 154(b) by 58 days.

(21) Appl. No.: 12/071,245

(22) Filed: Feb. 19, 2008

(65) Prior Publication Data

US 2009/0206148 A1 Aug. 20, 2009

(51) Int. Cl.
*G09F 1/00* (2006.01)

(52) U.S. Cl. ..... 40/124.08; 229/71; 446/148

(58) Field of Classification Search . 40/124.08–124.12, 40/124.91; 229/68.1, 71, 921; 283/116, 283/56; 446/148
See application file for complete search history.

(56) References Cited

U.S. PATENT DOCUMENTS 1,462,513 A 7/1923 Lover
1,550,750 A * 8/1925 Shannon ..... 229/311
1,682,594 A 8/1928 Benjamin
1,957,684 A * 5/1934 Will ..... 229/312
2,139,654 A * 12/1938 Berkowitz ..... 229/68.1
2,148,279 A * 2/1939 Sandberg ..... 40/124.08
2,884,184 A * 4/1959 Turan ..... 229/92.1
3,195,802 A * 7/1965 Jacobs ..... 229/72
3,995,388 A 12/1976 Penick et al.
4,337,589 A 7/1982 Volkert et al.
4,548,352 A 10/1985 Capo et al.
4,592,573 A * 6/1986 Crowell ..... 283/56
4,949,482 A 8/1990 Price
5,010,669 A 4/1991 Moran
5,104,124 A 4/1992 Bernard et al.
5,133,496 A 7/1992 Davidson et al.
5,232,087 A 8/1993 Schluger
5,406,716 A 4/1995 Rubinstein
5,472,240 A * 12/1995 Davies ..... 283/116
5,586,659 A 12/1996 Trumbo
5,613,612 A 3/1997 Davault
5,657,875 A 8/1997 Hirsh, III et al.
5,738,221 A 4/1998 Van Witt et al.
5,813,596 A 9/1998 Dahlquist
5,884,770 A 3/1999 Galm
5,967,557 A * 10/1999 Dahlquist ..... 283/56
6,418,648 B1 * 7/2002 Hollingsworth et al. .. 40/124.14

(Continued)

FOREIGN PATENT DOCUMENTS

FR 2603394 3/1988

(Continued)

*Primary Examiner*—Cassandra Davis
(74) *Attorney, Agent, or Firm*—Richard C. Litman

(57) ABSTRACT

The envelope with interior decorative elements is an envelope for receiving a greeting card, which may be further opened to display additional, decorative elements mounted within an interior thereof. The envelope includes first and second outer panels, each outer panel having an interior surface and an exterior surface. An inner panel is further provided so that, when the envelope is in a closed configuration, the inner panel is sandwiched between the first and second outer panels. An exterior surface of the inner panel is positioned adjacent an interior surface of the second outer panel so that a pocket is defined therebetween. The pocket is adapted for receiving the greeting card. The first and second outer panels may be separated so that, when folded apart, a pop-up decorative element is displayed, the decorative element being mounted on the interior surfaces of the inner panel and the first outer panel.

6 Claims, 4 Drawing Sheets

U.S. PATENT DOCUMENTS

| | | | | |
|---|---|---|---|---|
| 6,966,135 | B1 | 11/2005 | McDonald | |
| D532,452 | S | 11/2006 | Heng et al. | |
| D534,210 | S | 12/2006 | Vanderpool | |
| 2003/0230515 | A1 | 12/2003 | Mouyal | |
| 2006/0064906 | A1 | 3/2006 | Flemons | |
| 2006/0096138 | A1 * | 5/2006 | Clegg | 40/124.08 |
| 2006/0283922 | A1 | 12/2006 | Hurwitz | |

FOREIGN PATENT DOCUMENTS

| | | | |
|---|---|---|---|
| GB | 2134849 | A | 8/1984 |
| GB | 2230757 | A | 10/1990 |
| JP | 8185118 | | 7/1996 |

* cited by examiner

ENVELOPE WITH INTERIOR DECORATIVE ELEMENTS

BACKGROUND OF THE INVENTION

1. Field of the Invention

The present invention relates to stationery, and particularly to an envelope with interior decorative elements having an element that pops up when the envelope is folded open.

2. Description of the Related Art

Greeting cards typically come with envelopes that are sized and shaped to snugly and securely receive them. Although the cards themselves may be provided with ornamentation and decoration, the envelopes are typically utilitarian and functional in appearance, with the only variation usually being in the color of the paper.

Such conventional envelopes typically are folded over and secured with adhesive in such a manner that it defines a pocket therein with a fold-over sealing flap for receiving the greeting card. The envelopes typically provided with greeting cards are designed for functionality, rather than decorative, ornamental or design purposes. It would be desirable to provide an envelope that includes ornamentation additional to the ornamentation typically only found on the greeting card itself.

Thus, an envelope with interior decorative elements solving the aforementioned problems is desired.

SUMMARY OF THE INVENTION

The envelope with interior decorative elements is an envelope for receiving a greeting card or the like, which may be further opened to display additional, user-selectable decorative elements mounted within an interior thereof. The envelope includes first and second outer panels, each of the outer panels having an interior surface and an exterior surface. Each outer panel has a substantially rectangular shape in the preferred embodiment, as is conventionally known, although the envelope may have other shapes.

Each outer panel includes a pair of longitudinally opposed side edges and a pair of laterally opposed side edges. The first and second outer panels are joined together along inner aspects of the longitudinally opposed side edges. Preferably, the first and second outer panels are formed integrally as a single sheet, with the division between the first and second outer panels being along a central fold line.

As is conventionally known, a flap extends from an outer one of the longitudinally opposed side edges of the first outer panel. An inner panel having an interior surface and an exterior surface is further provided, with the inner panel having a pair of longitudinally opposed side edges and a pair of laterally opposed side edges. The inner panel is dimensioned and configured substantially identically with the first outer panel.

The pair of laterally opposed side edges of the inner panel are joined to the pair of laterally opposed side edges of the second outer panel so that a pocket is formed between the exterior surface of the inner panel and the interior surface of the second outer panel. The pocket is adapted for receiving a greeting card or the like, as is conventionally known. The flap selectively seals and covers the pocket.

Further, at least one decorative element is formed on the interior surface of the inner panel and the interior surface of the first outer panel. The laterally opposed side edges of the first outer panel are frangibly joined to the laterally opposed side edges of the second outer panel so that the first and second outer panels may be selectively separated to display the at least one decorative element. Prior to separation, the inner panel is sandwiched between the first and second outer panels. Following separation, the inner panel remains secured to the second outer panel, and both are folded away from the first outer panel to reveal the interior decorative elements. A plurality of perforations may be formed through the laterally opposed side edges of the first and second outer panels, allowing for the frangible joining of the first and second outer panels to each other.

The at least one decorative element preferably includes a user-selectable decorative ornament, which, when the first and second outer panels are folded apart, is mounted on, and raised above, the interior surfaces of the inner panel and the first outer panel. The decorative ornament is preferably a pop-up ornament, which rises as the first outer panel and the inner panel are folded apart. Preferably, the pop-up ornament is positioned substantially centrally with respect to the first outer panel and the interior panel, above the fold line joining the first and second outer panels. Further, user-selectable indicia and additional decorative elements may be formed on the interior surfaces of the inner panel and the first outer panel.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
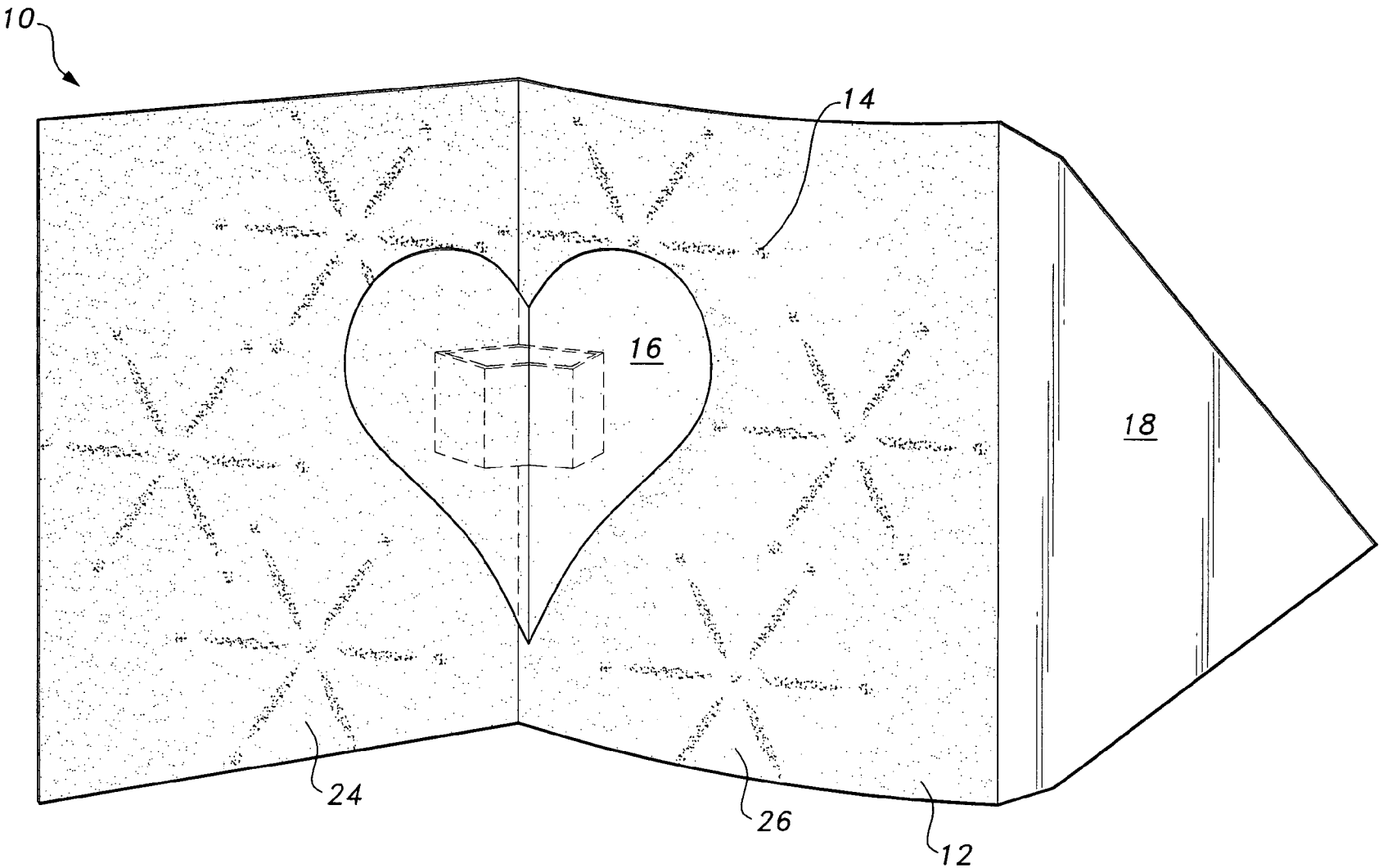
FIG. 1 is a perspective view of an envelope with interior decorative elements according to the present invention, with the envelope being shown in an open configuration.

The present invention is directed towards an envelope with interior decorative elements 10, as shown in FIGS. 1-4. The envelope with interior decorative elements 10 is an envelope for receiving a greeting card C or the like, and which may be further opened to display additional, user-selectable decorative elements, mounted within an interior region 12 thereof, as best shown in FIG. 1.

Figure 2:
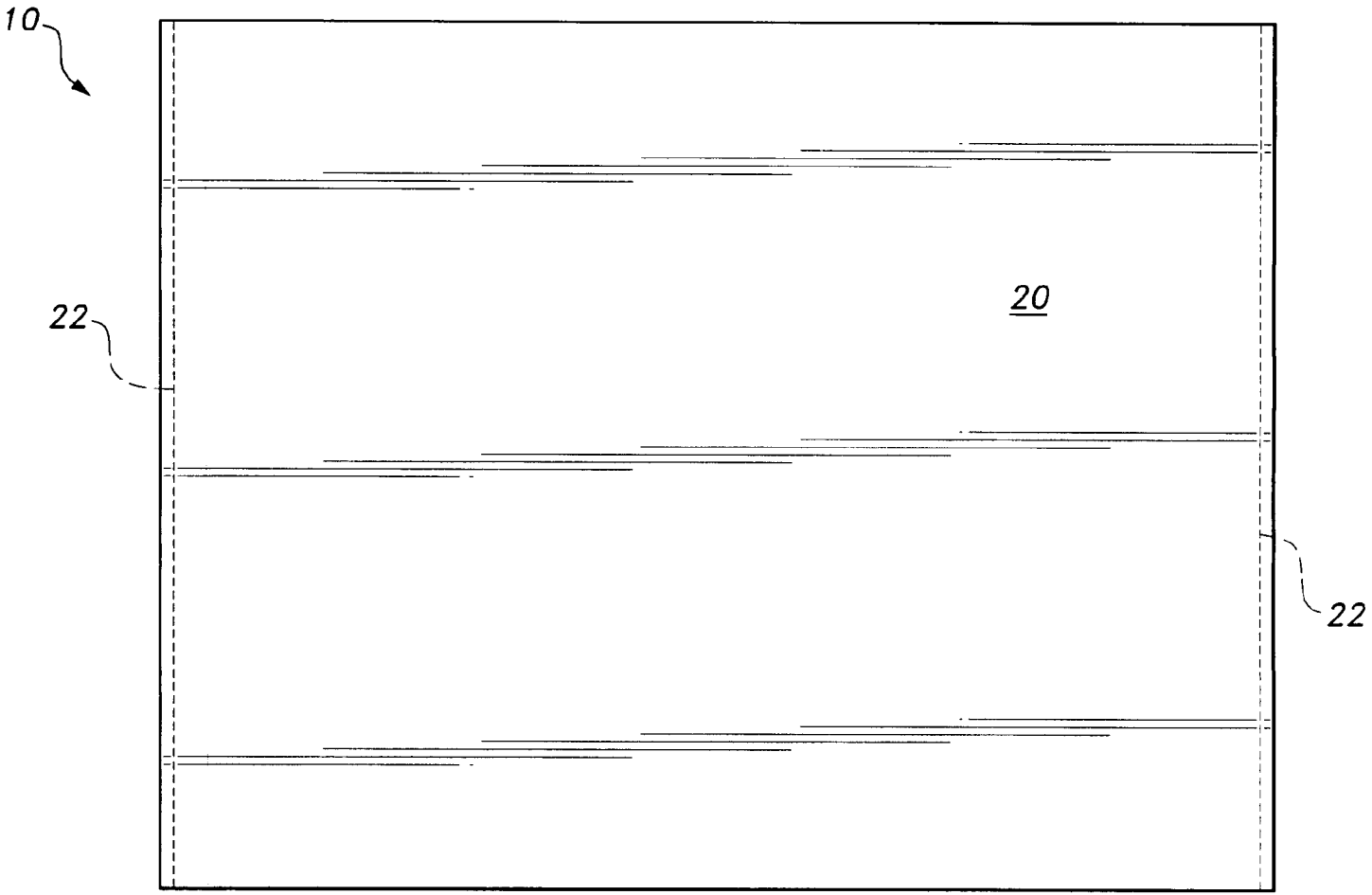
FIG. 2 is a front view of the envelope with interior decorative elements according to the present invention.
Figure 3:
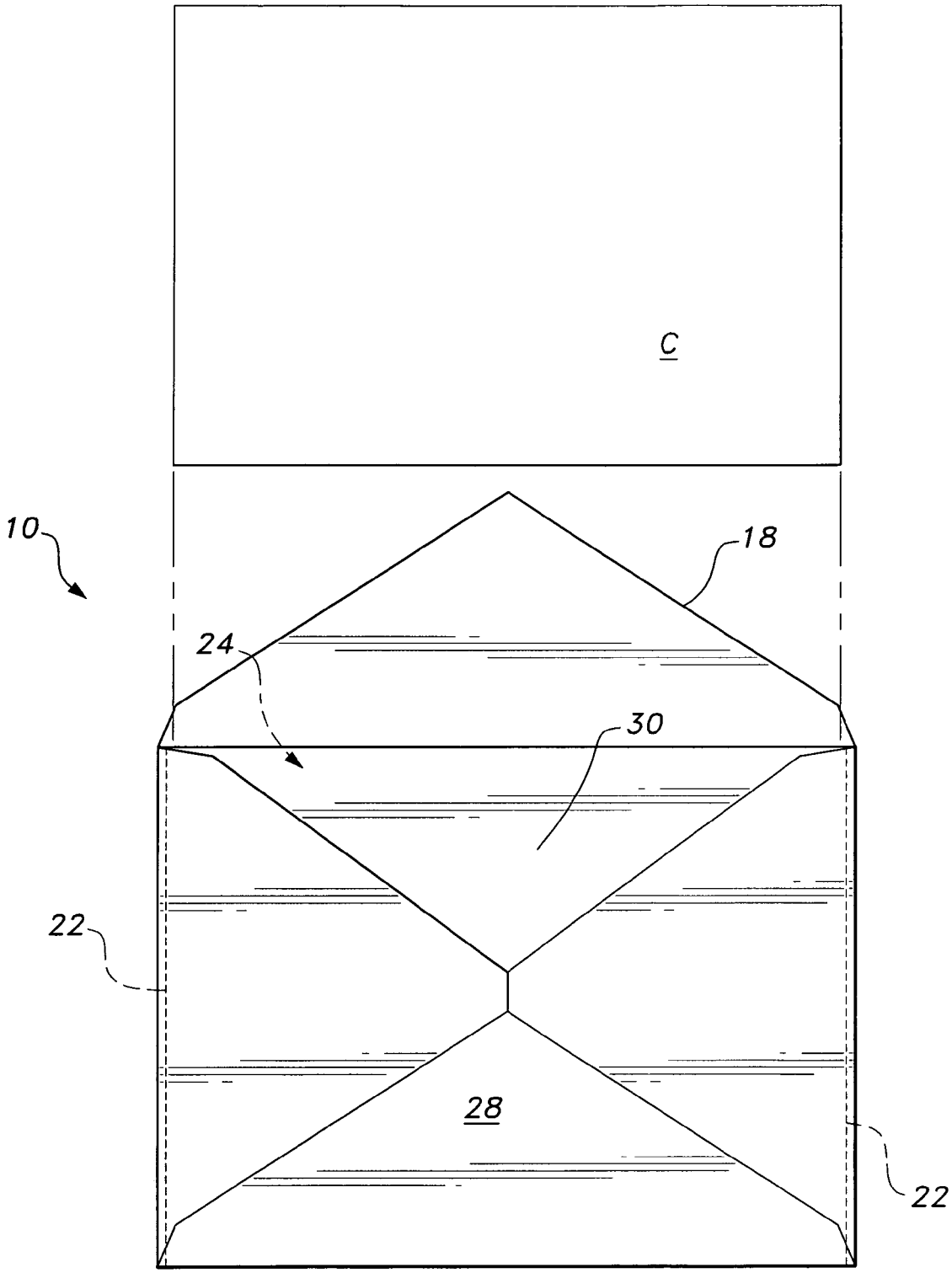
FIG. 3 is a rear view of the envelope with interior decorative elements according to the present invention.
Figure 4:
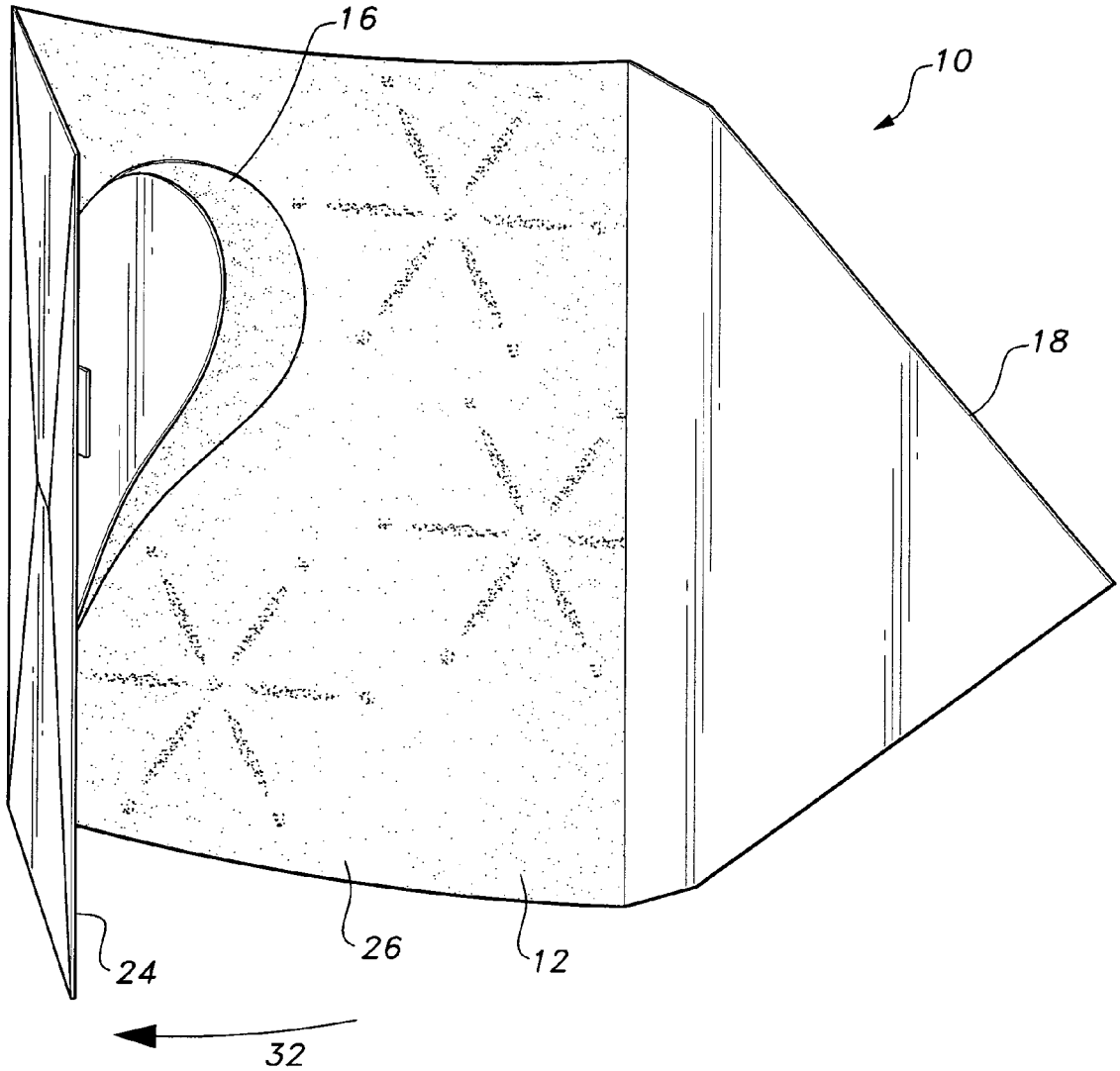
FIG. 4 is a perspective view of the envelope with interior decorative elements according to the present invention, with the envelope being shown in a partially unfolded configuration.

The envelope 10 includes first and second outer panels, with each outer panel having an interior surface and an exterior surface. As shown in FIG. 1, the interior surface of the first outer panel is designated generally as 26, and as shown in FIG. 2, the exterior surface of the first outer panel is designated generally as 20. In FIG. 2, the envelope 10 is shown in a closed, sealed configuration. As shown in FIG. 3, the exterior surface of the second outer panel is designated generally as 28.

Each outer panel has a substantially rectangular shape in the preferred embodiment, as is conventionally known, although it should be understood that the envelope may have other shapes. It should be understood that the envelope may be used to hold any desired contents, and that greeting card C is shown in FIG. 3 for exemplary purposes only. Further, envelope 10 may be constructed from any suitable materials, such as heavy paper.

Each outer panel includes a pair of longitudinally opposed side edges and a pair of laterally opposed side edges. The first and second outer panels are joined together along inner aspects of the longitudinally opposed side edges. Preferably, the first and second outer panels are formed integrally as a single sheet, with the division between the first and second outer panels being along a central fold line, as shown.

As is conventionally known, a flap 18 extends from an outer one of the longitudinally opposed side edges of the first outer panel. An inner panel 24 having an interior surface and an exterior surface is further provided, with the inner panel 24 having a pair of longitudinally opposed side edges and a pair of laterally opposed side edges. The inner panel 24 is preferably dimensioned and configured substantially identically with the first outer panel, as shown.

The pair of laterally opposed side edges of the inner panel 24 are joined to the pair of laterally opposed side edges of the second outer panel so that a pocket 30 (shown in FIG. 3) is formed between the exterior surface of the inner panel 24 and the interior surface of the second outer panel. The pocket 30 is adapted for receiving greeting card C or the like, as is conventionally known. The flap 18 selectively seals and covers the pocket 30. Inner panel 24 may be secured to the interior surface of the second outer panel in any suitable manner.

Further, at least one decorative element 16 is formed on the interior surface of the inner panel 24 and the interior surface 26 of the first outer panel. The laterally opposed side edges of the first outer panel are frangibly joined to the laterally opposed side edges of the second outer panel so that the first and second outer panels may be selectively separated to display the at least one decorative element 16. Prior to separation, the inner panel 24 is sandwiched between the first and second outer panels.

Following separation, the inner panel 24 remains secured to the second outer panel, and both are folded away from the first outer panel (shown by directional arrow 32 in FIG. 4) to reveal the interior decorative elements. A plurality of perforations 22 may be formed through the laterally opposed side edges of the first and second outer panels, allowing for the frangible joining of the first and second outer panels, each to the other. Alternatively, the edges may be formed without perforations and joined together in a manner similar to a conventional envelope. In this alternative, the user would separate the panels using a letter opener, knife or the like.

The at least one decorative element 16 preferably includes a user-selectable decorative ornament, which, when the first and second outer panels are folded apart, is mounted on, and raised above, the interior surfaces of the inner panel 24 and the first outer panel 26. The decorative ornament 16 is preferably a pop-up ornament, which rises as the first outer panel and the inner panel are folded apart. Pop-up displays are well known in the art and one such pop-up construction is illustrated in U.S. Pat. No. 6,966,135, which is herein incorporated by reference. It should be understood that any type of pop-up decorative element may be used.

Preferably, the pop-up ornament 16 is positioned substantially centrally with respect to the first outer panel and the interior panel, above the fold line joining the first and second outer panels. Further, user-selectable indicia 14 and additional decorative elements may be formed on the interior surfaces of the inner panel and the first outer panel. The indicia and decorative elements may include printing, reflective surfaces, messages, ornaments, glitter and the like.

It is to be understood that the present invention is not limited to the embodiments described above, but encompasses any and all embodiments within the scope of the following claims.

I claim:

1. An envelope with interior decorative elements, comprising:

first and second outer panels, each of the outer panels having an interior surface and an exterior surface, the outer panels having a pair of longitudinally opposed side edges and a pair of laterally opposed side edges, the first and second outer panels being joined together along inner aspects of the longitudinally opposed side edges;

a flap extending from an outer one of the longitudinally opposed side edges of the outer panel;

an inner panel having an interior surface and an exterior surface, the inner panel having a pair of longitudinally opposed side edges and a pair of laterally opposed side edges, the pair of laterally opposed side edges of the inner panel being joined to the pair of laterally opposed side edges of the second outer panel and forming a pocket between the exterior surface of the inner panel and the interior surface of the second outer panel, the flap selectively sealing and covering the pocket; and at least one decorative element formed on the interior surface of the inner panel and the interior surface of the first outer panel, the laterally opposed side edges of the first outer panel being frangibly joined to the laterally opposed side edges of the second outer panel so that the first and second outer panels may be selectively separated to display the at least one decorative element.

2. The envelope with interior decorative elements as recited in claim 1, wherein the at least one decorative element comprises a decorative ornament positioned above respective interior surfaces of said first outer panel and said inner panel.

3. The envelope with interior decorative elements as recited in claim 2, wherein the decorative ornament comprises a pop-up ornament, the pop-up ornament rising when said first outer panel and said inner panel are folded apart.

4. The envelope with interior decorative elements as recited in claim 3, wherein the interior surfaces of said inner panel and said first outer panel are adapted for having user-selectable indicia formed thereon.

5. The envelope with interior decorative elements as recited in claim 3, wherein the pop-up ornament is positioned substantially centrally with respect to said first outer panel and said interior panel.

6. The envelope with interior decorative elements as recited in claim 1, wherein a plurality of perforations are formed through the respective pairs of laterally opposed side edges of said first and second outer panels.

* * * * *